US008781823B2

(12) United States Patent
Endo

(10) Patent No.: US 8,781,823 B2
(45) Date of Patent: Jul. 15, 2014

(54) VOICE BAND ENHANCEMENT APPARATUS AND VOICE BAND ENHANCEMENT METHOD THAT GENERATE WIDE-BAND SPECTRUM

(75) Inventor: Kaori Endo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 187 days.

(21) Appl. No.: 13/067,120

(22) Filed: May 10, 2011

(65) Prior Publication Data

US 2011/0282655 A1 Nov. 17, 2011

Related U.S. Application Data

(63) Continuation of application No. PCT/JP2008/073236, filed on Dec. 19, 2008.

(51) Int. Cl.
*G10L 21/00* (2013.01)
*G10L 21/02* (2013.01)

(52) U.S. Cl.
USPC ..... 704/228; 701/225; 701/226

(58) Field of Classification Search
CPC .... G10L 21/038; G10L 21/0388; G10L 19/24
USPC ..... 704/225, 226, 228
See application file for complete search history.

(56) References Cited

U.S. PATENT DOCUMENTS 5,978,759 A 11/1999 Tsushima et al.
6,625,226 B1 * 9/2003 Gersho et al. ..... 375/285
6,680,972 B1 * 1/2004 Liljeryd et al. ..... 375/240
6,711,538 B1 3/2004 Omori et al.
6,978,236 B1 * 12/2005 Liljeryd et al. ..... 704/219
7,003,451 B2 * 2/2006 Kjorling et al. ..... 704/206
7,069,212 B2 * 6/2006 Tanaka et al. ..... 704/225
7,318,035 B2 * 1/2008 Andersen et al. ..... 704/500
7,831,434 B2 * 11/2010 Mehrotra et al. ..... 704/500
7,983,904 B2 * 7/2011 Ehara et al. ..... 704/205
8,271,292 B2 * 9/2012 Osada et al. ..... 704/500

(Continued)

FOREIGN PATENT DOCUMENTS

EP 1126620 8/2001
JP 08-130494 5/1996

(Continued)

OTHER PUBLICATIONS

Dietz et al. "Spectral Band Replication, a novel approach in audio coding" 2002.*

(Continued)

*Primary Examiner* — Eric Yen
(74) *Attorney, Agent, or Firm* — Staas & Halsey LLP

(57) ABSTRACT

A voice band enhancement apparatus is used that includes a frequency transform unit to perform frequency transform on an input signal to calculate a spectrum, a mapping function calculating unit to calculate, by use of the spectrum, a mapping function for generating high-range components from low-range components of the spectrum, a wide-band spectrum generating unit to generate, in a higher range than a band of the spectrum, a high-range spectrum based on the mapping function and to integrate the generated high-range spectrum and the spectrum calculated by the frequency transform unit, thereby generating a wide-band spectrum wider than the band of the spectrum calculated by the frequency transform unit, and an inverse frequency transform unit to perform inverse frequency transform on the wide-band spectrum to calculate an output signal.

6 Claims, 16 Drawing Sheets

(56) References Cited

U.S. PATENT DOCUMENTS

| | | | | |
|---|---|---|---|---|
| 8,560,330 | B2 * | 10/2013 | Gao | 704/501 |
| 2002/0029148 | A1 * | 3/2002 | Okayama et al. | 704/500 |
| 2004/0125878 | A1 * | 7/2004 | Liljeryd et al. | 375/242 |
| 2005/0149339 | A1 * | 7/2005 | Tanaka et al. | 704/500 |
| 2006/0036432 | A1 * | 2/2006 | Kjorling et al. | 704/206 |
| 2006/0106619 | A1 * | 5/2006 | Iser et al. | 704/500 |
| 2006/0217975 | A1 * | 9/2006 | Sung et al. | 704/228 |
| 2006/0271356 | A1 * | 11/2006 | Vos | 704/222 |
| 2007/0040709 | A1 * | 2/2007 | Sung et al. | 341/50 |
| 2007/0088541 | A1 * | 4/2007 | Vos et al. | 704/219 |
| 2008/0027711 | A1 * | 1/2008 | Rajendran et al. | 704/201 |
| 2008/0052066 | A1 * | 2/2008 | Oshikiri et al. | 704/221 |
| 2008/0109215 | A1 | 5/2008 | Liu et al. | |
| 2008/0126081 | A1 * | 5/2008 | Geiser et al. | 704/201 |
| 2008/0129350 | A1 | 6/2008 | Mitsufuji et al. | |
| 2008/0177532 | A1 * | 7/2008 | Greiss et al. | 704/200.1 |
| 2008/0215344 | A1 * | 9/2008 | Song et al. | 704/500 |
| 2008/0300866 | A1 * | 12/2008 | Mukhtar et al. | 704/205 |
| 2009/0157413 | A1 * | 6/2009 | Oshikiri | 704/501 |
| 2009/0226010 | A1 * | 9/2009 | Schnell et al. | 381/119 |
| 2009/0278573 | A1 * | 11/2009 | Tashiro | 327/113 |
| 2009/0292537 | A1 * | 11/2009 | Ehara et al. | 704/230 |
| 2009/0319277 | A1 * | 12/2009 | Black | 704/500 |
| 2009/0326929 | A1 * | 12/2009 | Kjorling et al. | 704/206 |
| 2010/0198587 | A1 * | 8/2010 | Ramabadran et al. | 704/205 |
| 2010/0246803 | A1 * | 9/2010 | Tashiro et al. | 379/392.01 |

FOREIGN PATENT DOCUMENTS

| | | |
|---|---|---|
| JP | 09-055778 | 2/1997 |
| JP | 09-101798 | 4/1997 |
| JP | 2001-100773 | 4/2001 |
| JP | 2004-198485 | 7/2004 |
| JP | 2005-321826 | 11/2005 |
| JP | 2007-310296 | 11/2007 |
| JP | 2008-139844 | 6/2008 |
| WO | 01/35395 | 5/2001 |
| WO | 03/003350 | 1/2003 |

OTHER PUBLICATIONS

Friedrich et al. "Spectral Band Replication Tool for Very Lowdelay Audio Coding Applications" Oct. 24, 2007.*

International Search Report for PCT/JP2008/073236, Mailed Feb. 24, 2009.

Extended European Search Report dated Jun. 13, 2012 issued in corresponding European Patent No. 08878936.7.

* cited by examiner

VOICE BAND ENHANCEMENT APPARATUS AND VOICE BAND ENHANCEMENT METHOD THAT GENERATE WIDE-BAND SPECTRUM

CROSS REFERENCE TO RELATED APPLICATIONS

This application is a continuation application, filed under 35 U.S.C. §111(a), of International Application PCT/JP2008/073236, filed Dec. 19, 2008, the disclosures of which are hereby incorporated by reference.

TECHNICAL FIELD

The present invention relates to a voice band enhancement apparatus and a voice band enhancement method for generating a broader-band voice signal from a narrower-band voice signal.

BACKGROUND ART

A study has been made on technologies for simulating a wider band signal on a receiver side from a voice signal whose frequency band is narrowed through transmission.

A certain band enhancing technology applies linear prediction analysis to a voice signal to separate the spectrum envelope from sound source, and then generates a high-band signal by transforming the sound source signal through nonlinear processing such as full-wave rectification or half-wave rectification, thereby producing a wider band. Further, the spectrum envelope is converted into a wider-band envelope by using a pre-learned mapping function that maps a narrower-band spectrum envelope to a wider-band spectrum envelope. In this technology known in the art, the wider-band spectrum envelope and the wider-band source signal are combined to generate a wider-band signal.

Further, another technology known in the art applies linear prediction analysis to a voice signal to separate the spectrum envelope from sound source, and obtains a fundamental frequency of the sound source signal to shift the sound source signal to a higher range and to a lower range by a frequency equal to an integer multiple of the fundamental frequency, thereby achieving band broadening.

[Patent Document 1] Japanese Laid-open Patent Publication No. 09-101798

[Patent Document 2] Japanese Laid-open Patent. Publication No. 09-055778

DISCLOSURE OF INVENTION

Problem to be Solved by Invention

The mapping function that is calculated through learning in advance to generate a wider-band signal from a narrower-band signal provides an average mapping relationship that is learned from a larger number of data. Such an average mapping function differs from the one that is optimal for a target voice signal. Because of this, a high-quality wider-band signal may not be obtained. An attempt to achieve high sound quality requires various sound signals stored in memory, resulting in an increase in the database size.

Further, a high-sound-quality wider-band signal cannot be obtained by the method that applies nonlinear processing to a sound source signal and shifts the narrower-band frequency components to lower and higher ranges by a frequency equal to an integer multiple of the fundamental frequency to achieve a wider band. This is because real voices differ from the narrower-band frequency components that are simply shifted.

Means to Solve the Problem

A disclosed voice band enhancement apparatus includes a frequency transform unit to perform frequency transform on an input signal to calculate a spectrum, a mapping function calculating unit to calculate, by use of the spectrum, a mapping function for generating high-range components from low-range components of the spectrum, a wide-band spectrum generating unit to generate, in a higher range than a band of the spectrum, a high-range spectrum based on the mapping function and to integrate the generated high-range spectrum and the spectrum calculated by the frequency transform unit, thereby generating a wide-band spectrum wider than the band of the spectrum calculated by the frequency transform unit, and an inverse frequency transform unit to perform inverse frequency transform on the wide-band spectrum to calculate an output signal.

Advantage of the Invention

According to a disclosed embodiment, a narrow-band signal spectrum is used to calculate a mapping function, which is then used to generate a high-range spectrum higher than the narrow band to perform band broadening, thereby providing a wide-band signal having high sound quality.

DESCRIPTION OF REFERENCE SYMBOLS

Figure 1:
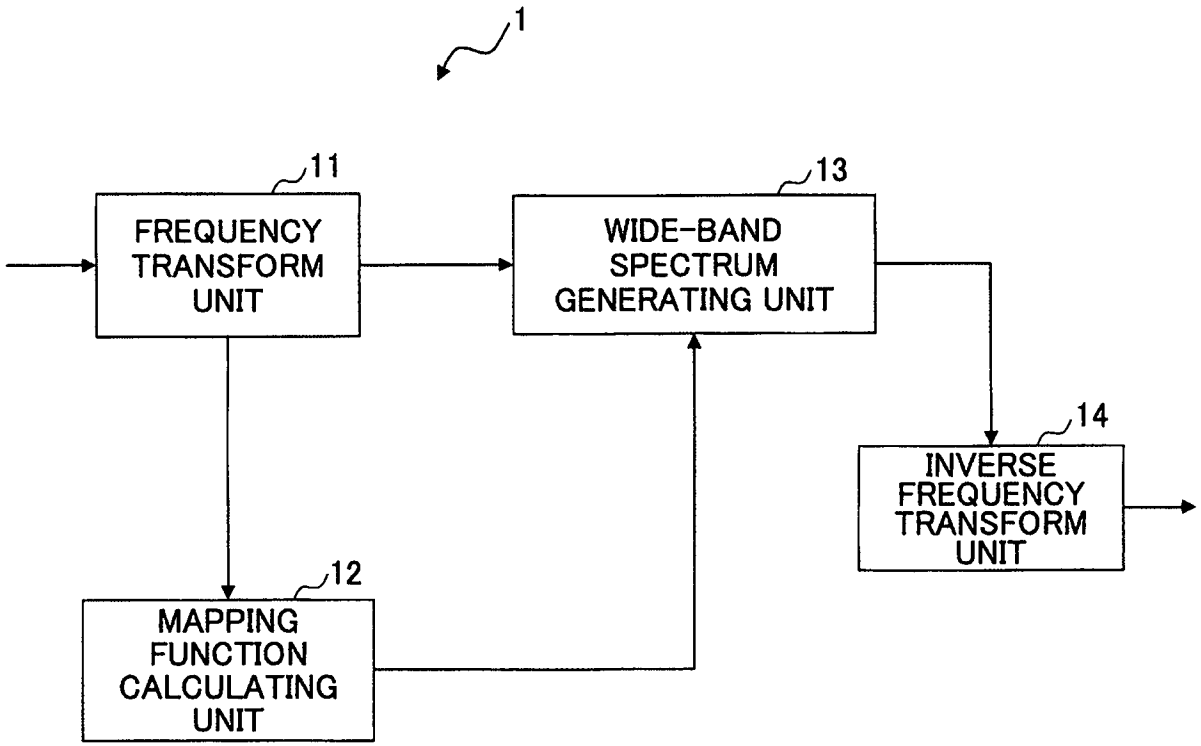
FIG. 1 is a block diagram illustrating an example of a main functional configuration of a voice band enhancer apparatus according to the first embodiment.

11 frequency transform unit
12, 32 mapping function calculating unit
13, 22, 33, 42 wide-band spectrum generating unit
14 inverse frequency transform unit
21, 41 mapping function evaluating unit
31 sound-source-and-envelope separating unit
131 high-range spectrum generating unit
132, 222, 332, 422 integration unit
221 spectrum modifying unit
331, 421 high-range separate-information generating unit
333, 423 sound-source-and-envelope combining unit

BEST MODE FOR CARRYING OUT THE INVENTION

In the following, embodiments will be described with reference to the accompanying drawings.

First Embodiment

Functional Configuration

FIG. 1 is a block diagram illustrating an example of a main functional configuration of a voice band enhancement apparatus 1 according to the first embodiment. As illustrated in FIG. 1, the voice band enhancement apparatus 1 includes a frequency transform unit 11, a mapping function calculating unit 12, a wide-band spectrum generating unit 13, and an inverse frequency transform unit 14.

The frequency transform unit 11 receives a voice input signal (which may hereinafter be referred to as a narrow-band signal) through a network or the like. The frequency transform unit 11 applies time-frequency transform (hereinafter referred to as frequency transform) to calculate frequency information (hereinafter referred to as spectrum). The frequency transform may be performed by using a technique such as Fourier transform or discrete cosine transform. Although a description will be given of an example in which the input signal is a narrow-band signal within the range of 300 Hz to 3400 Hz, the band is not limited to such an example. The frequency transform unit 11 supplies the calculated spectrum to the mapping function calculating unit 12 and the wide-band spectrum generating unit 13.

The mapping function calculating unit 12 calculates a mapping function for generating higher range components from lower range components with respect to the spectrum received from the frequency transform unit 11. In the following, an example of the mapping function will be described. Expression (1) represents a model of a spectrum mapping function.

$$\hat{y}(x_i) = (ax_i + b)\sin(\theta x_i) \tag{1}$$

$\hat{y}(x_i)$:

Spectrum Estimate at Frequency $x_i$
$x_i$: Frequency
a, b: Mapping Function Parameter
θ: Pitch Frequency
i: 0, . . . , N−1 (Frequency Band Index)
N: Number of Sections in Frequency Band Here, an error between a spectrum estimate and an actual spectrum $y(x_i)$ is calculated by use of formula (2).

$$E = \sum_{i=0}^{N-1} \{(ax_i + b)\sin(\theta x_i) - y(x_i)\}^2 \tag{2}$$

$$\frac{\partial E}{\partial a} = 0 \tag{3}$$

$$\frac{\partial E}{\partial b} = 0 \tag{4}$$

Parameters a and b of the model are calculated by formulas (2), (3), and (4) using the spectrum $y(x_i)$ of the narrow-band signal. Here, a pitch frequency θ is calculated by use of the following formulas.

$$\mathrm{corr}(a) = \frac{\sum_{i=0}^{M-1} x(i-a)x(i)}{\sqrt{\sum_{i=0}^{M-1} x(i-a)^2}\sqrt{\sum_{i=0}^{M-1} x(i)^2}} \tag{5}$$

$$\theta = freq/\mathrm{a_max} \tag{6}$$

x: Input Signal
M: Length of Segment for Calculating Correlation Coefficient (Sample)
a: Start Position of Signal for Calculating Correlation Coefficient
corr(a): Correlation Coefficient for Shift Being Equal to a
a_max: a for Maximum Correlation Coefficient
i: Signal Index (Sample)
freq: Sampling Frequency (Hz)

Parameters a and b of the model are calculated as described above, thereby calculating a mapping function for generating high-range components from low-range components with respect to the input signal spectrum. The model described above is only an example, and is not limited to this specific model. The mapping function calculating unit 12 supplies the calculated mapping function to the wide-band spectrum generating unit 13.

The wide-band spectrum generating unit 13 receives the narrow-band signal spectrum from the frequency transform unit 11, and receives the mapping function from the mapping function calculating unit 12. The wide-band spectrum generating unit 13 then uses the received spectrum and the mapping function to generate a spectrum having a band wider than the band of the narrow-band signal. The wide-band spectrum generating unit 13 will be described in detail by referring to FIG. 2. The wide-band spectrum generating unit 13 supplies the generated wide-band spectrum to the inverse frequency transform unit 14.

Figure 2:
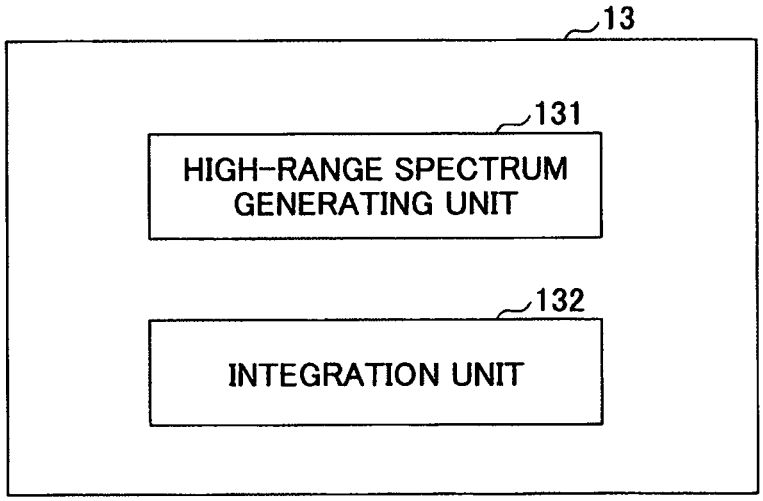
FIG. 2 is a block diagram illustrating an example of a main functional configuration of a wide-band spectrum generating unit.

FIG. 2 is a block diagram illustrating an example of a main functional configuration of the wide-band spectrum generating unit 13. As illustrated in FIG. 2, the wide-band spectrum generating unit 13 includes a high-range spectrum generating unit 131 and an integration unit 132.

The high-range spectrum generating unit 131 inputs high-range frequencies above the narrow band into the mapping function received from the mapping function calculating unit 12, thereby generating a spectrum in a range higher than the narrow-band spectrum.

The integration unit 132 integrates the narrow-band spectrum and the high-range spectrum generated by the high-range spectrum generating unit 131, thereby generating a wide-band spectrum. In the following, a description will be given of an example in which band broadening is applied to a narrow-band signal. In this example that will be described, the narrow-band signal spectrum has information in 0 to T band segments, and is broadened to twice the number, i.e., to 0 to 2T band segments.

First, the narrow-band signal spectrum is set to the narrow-band components of the wide-band spectrum.

$$S_w[i]=S_n[i]\ i=0,\ldots,T-1 \tag{7}$$

Then, the spectrum generated by use of the mapping function is set to the high-range components of the wide-band spectrum.

$$S_w[i]=S_f[i]\ i=T,\ldots,2T-1 \tag{8}$$

The Nyquist frequency component is zero.

$$S_w[2T]=0 \tag{9}$$

S_w[i]: Wide-Band Spectrum of i-th Frequency Band
S_n[i]: Narrow-Band Spectrum of i-th Frequency Band
S_f[i]: Spectrum of i-th Frequency Band Generated by Applying Mapping Function In this manner, the number of band segments may be doubled compared with a narrow-band spectrum to generate a wide-band spectrum.

Referring to FIG. 1 again, the inverse frequency transform unit 14 receives the wide-band spectrum from the wide-band spectrum generating unit 13, and applies frequency-time transform (i.e., inverse frequency transform) to the received wide-band spectrum to calculate an output signal in the time domain.

Figure 3:
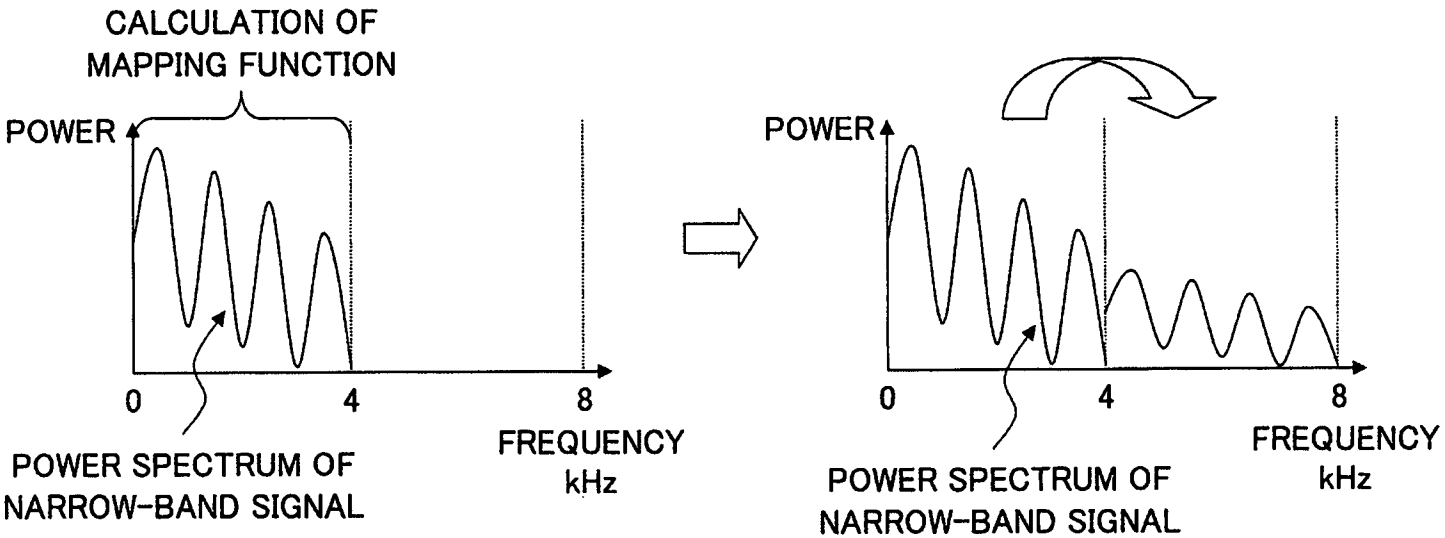
FIG. 3 is a conceptual diagram illustrating the process of generating a high-range spectrum.

In the following, a description will be given of an example of generating a high-range spectrum by use of a specific example illustrated in FIG. 3. FIG. 3 is a conceptual diagram illustrating the process of generating a high-range spectrum. With reference to FIG. 3, a description will be given of the process of generating a high-range spectrum in the range of 4 to 8 kHz from a narrow-band signal in the range of 0 to 4 kHz.

In the example illustrated in FIG. 3, a mapping function for generating a high-range spectrum (e.g., in the range of 4 to 8 kHz) from a narrow-band signal spectrum (e.g., in the range of 0 to 4 kHz) is calculated. Then, frequencies in the high range (i.e., 4 to 8 kHz) are input into the mapping function to generate the high-range spectrum (i.e., in the range of 4 to 8 kHz). The narrow-band signal spectrum (0 to 4 kHz) and the generated high-range spectrum (4 to 8 kHz) are integrated to generate a wide-band spectrum (0 to 8 kHz).

Figure 4:
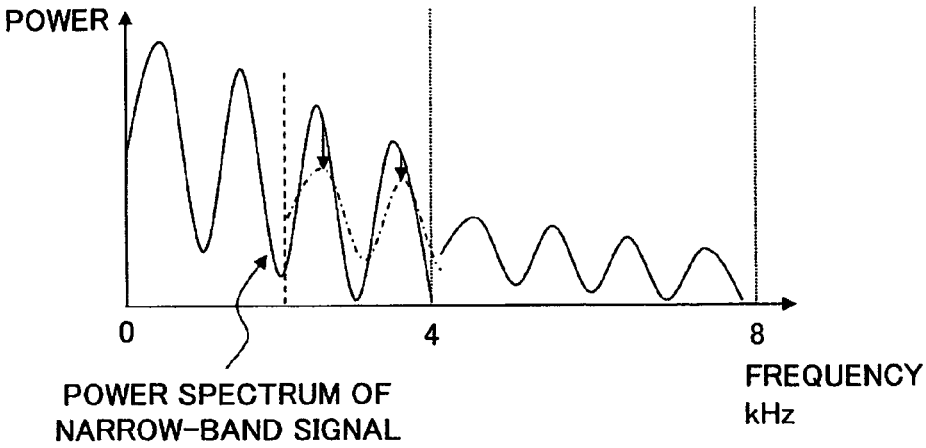
FIG. 4 is a drawing illustrating an example of a smoothing process.

At the time of integrating a high-range spectrum, a smoothing process as described in the following may be performed, rather than performing simple integration. This smoothing process will be described by referring to FIG. 4. FIG. 4 is a drawing illustrating an example of the smoothing process. As illustrated in FIG. 4, a spectrum in the high-range part of the narrow-band signal spectrum is generated by use of the mapping function (as illustrated by a chain line). Then, the narrow-band signal spectrum in this high range part may be modified to gradually become equal to the generated spectrum (chain line), thereby providing smooth transition at the boundary (i.e., 4 kHz).

Specifically, weighting coefficients may be determined such that the narrow-band signal spectrum in the high range part gradually becomes equal to the spectrum generated by the mapping function. These weighting coefficients are used to provide a weighted average between the high-range spectrum and the generated spectrum. This serves to prevent abnormal sound from being generated due to spectrum discontinuity at the boundary.

<Operation>

Figure 5:
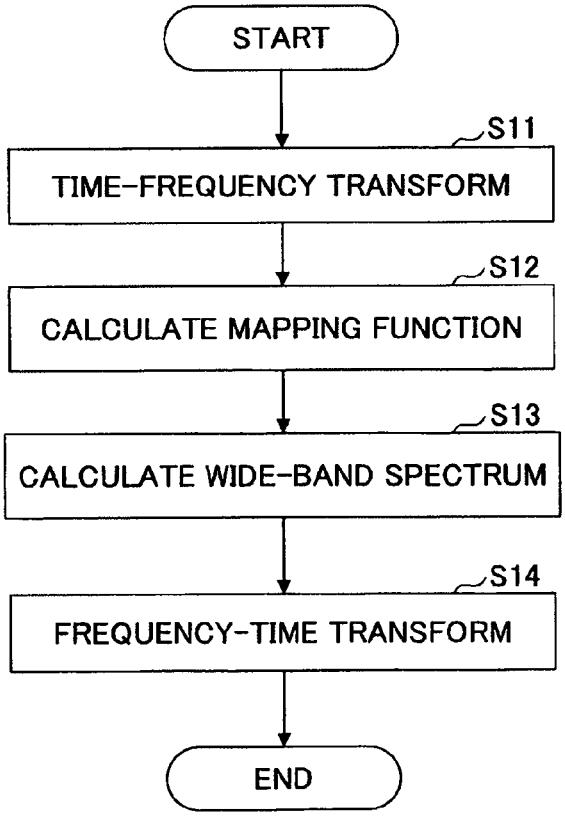
FIG. 5 is a flowchart illustrating an example of the voice band enhancing process according to the first embodiment.

In the following, a description will be given of the process performed by the voice band enhancement apparatus 1 according to the first embodiment. FIG. 5 is a flowchart illustrating an example of the voice band enhancing process according to the first embodiment. In step S11, the frequency transform unit 11 applies frequency transform (i.e., time-frequency transform) to the input signal in the time domain to calculate a frequency-domain spectrum.

In step S12, the mapping function calculating unit 12 calculates a mapping function for generating higher range components from lower range spectrum components by using the spectrum calculated by the frequency transform unit 11. Specifically, a model of the mapping function is provided, and its parameters are calculated as previously described.

In step S13, the wide-band spectrum generating unit 13 uses the spectrum generated by the frequency transform unit 11 and the mapping function calculated by the mapping function calculating unit 12 to generate a spectrum having a wider band than the narrow-band signal. Specifically, the high-range spectrum generating unit 131 inputs frequencies higher than the narrow band into the mapping function to generate a high-range spectrum. The integration unit 132 then integrates the narrow-band spectrum and the high-range spectrum generated by the high-range spectrum generating unit 131, thereby generating the wide-band spectrum.

In step S14, the inverse frequency transform unit 14 applies inverse frequency transform (i.e., frequency-time transform) to the wide-band spectrum generated by the wide-band spectrum generating unit 13 to calculate an output signal in the time domain.

According to the first embodiment described above, the narrow-band signal spectrum is used to calculate a mapping function, which is then used to generate a high-range spectrum to achieve band broadening. This serves to provide a wide-band signal having high sound quality. Further, a mapping function suitable for the input signal is obtained, which makes it possible to generate a high-range spectrum responsive to the characteristics of the input signal spectrum.

Moreover, the smoothing process may be performed at the time of spectrum integration. This prevents spectrum discontinuity from appearing at the boundary where spectrums are integrated, thereby generating a smooth spectrum even at such a boundary.

Second Embodiment

In the following, a voice band enhancement apparatus 2 according to a second embodiment will be described. In the second embodiment, a calculated mapping function is evaluated. Based on this evaluation, a decision may be made as to how much contribution is made by a calculated high-range spectrum and whether such a spectrum is at all used.

<Functional Configuration>

Figure 6:
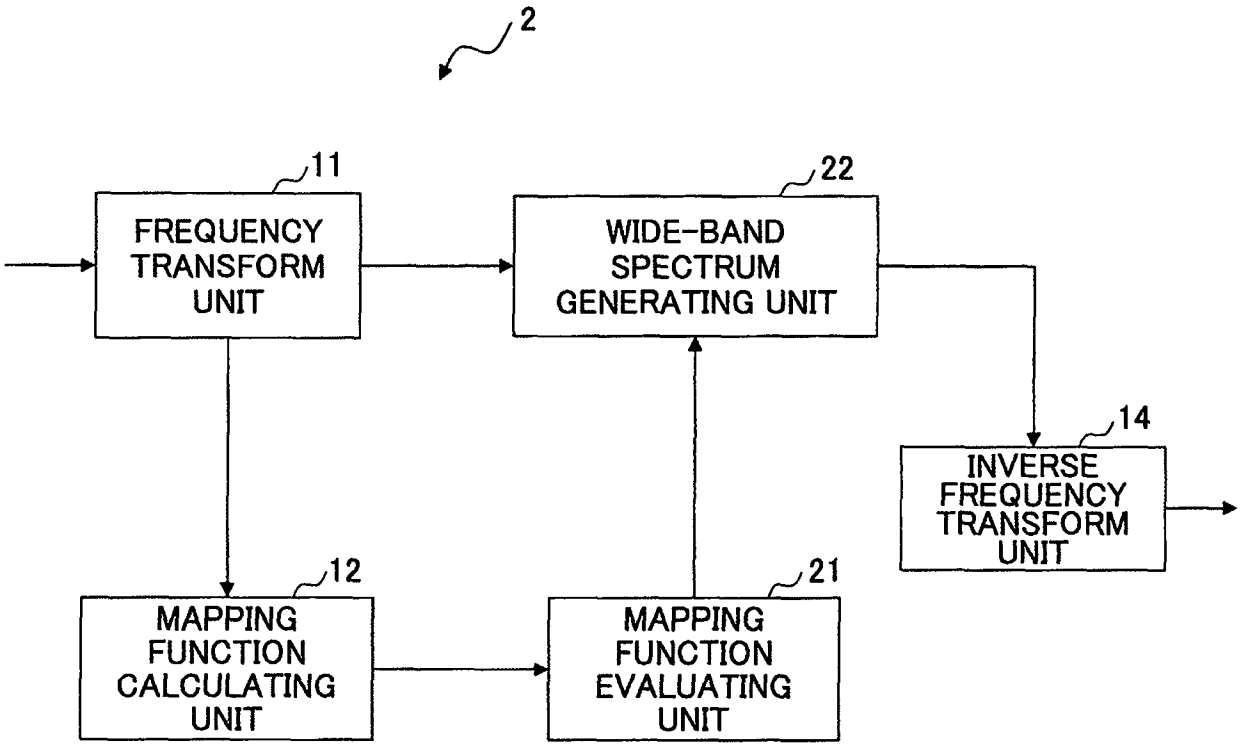
FIG. 6 is a block diagram illustrating an example of a main functional configuration of a voice band enhancer apparatus according to the second embodiment.

FIG. 6 is a block diagram illustrating an example of a main functional configuration of a voice band enhancement apparatus 2 according to the second embodiment. With respect to the functions illustrated in FIG. 6, the same or similar functions as those of FIG. 1 are referred to by the same numerals, and a description thereof will be omitted.

As illustrated in FIG. 6, the voice band enhancement apparatus 2 includes the frequency transform unit 11, the mapping function calculating unit 12, a mapping function evaluating unit 21, a wide-band spectrum generating unit 22, and the inverse frequency transform unit 14. In the following, the mapping function evaluating unit 21 and the wide-band spectrum generating unit 22 will be described.

The mapping function evaluating unit 21 evaluates the performance of the mapping function calculated by the mapping function calculating unit 12. Such evaluation of the mapping function may be made by calculating an evaluation value as follows. By use of formula (10), the mapping function evaluating unit 21 calculates an error V between the spectrum obtained by the frequency transformation of the input signal and the spectrum obtained by applying the mapping function.

$$V = \frac{\sum_{i=0}^{N-1} (\hat{y}(x_i) - y(x_i))^2}{\sum_{i=0}^{N-1} (y(x_i))^2} \tag{10}$$

Figure 7:
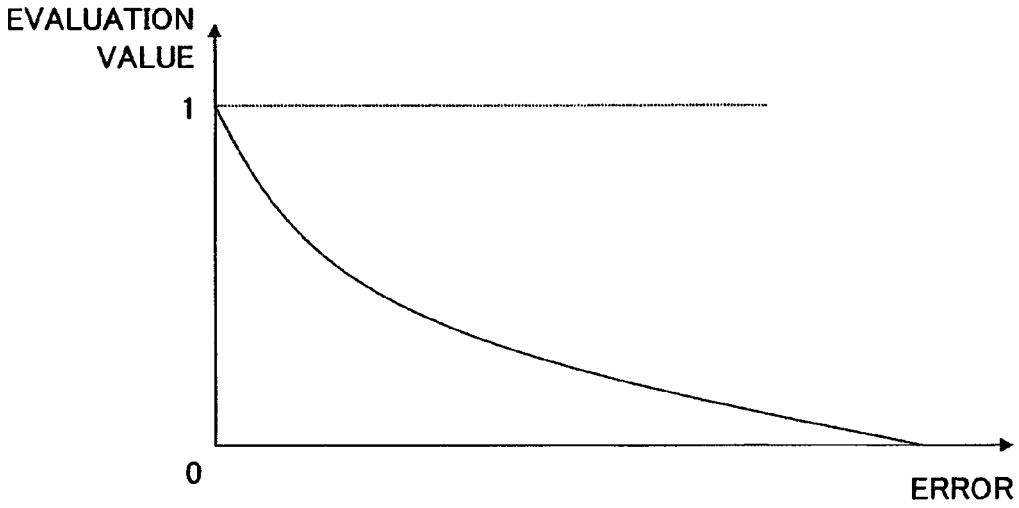
FIG. 7 is a drawing illustrating an example of a relationship between an evaluation value and an error.

Further, the mapping function evaluating unit 21 obtains an evaluation value from the error V calculated by use of the formula (10). For example, an evaluation value is calculated from the error by using FIG. 7. FIG. 7 is a drawing illustrating an example of a relationship between the evaluation value and the error.

As illustrated in FIG. 7, the evaluation value is larger than or equal to 0, and is smaller than or equal to 1. A function is preset to provide an evaluation value that decreases as the error increases. A correspondence table between the evaluation value and the error may be provided in place of such a function.

The relationship between the evaluation value and the error illustrated in FIG. 7 is only an example. Any relationship suffices as long as the evaluation value decreases as the error increases. A further condition may be imposed such that the evaluation value becomes zero for the error that is larger than or equal to a predetermined value. An inverse of the error may be used as an evaluation value. The evaluation value calculated from the error is supplied together with the mapping function to the wide-band spectrum generating unit 22.

Referring to FIG. 6 again, the wide-band spectrum generating unit 22 uses the narrow-band signal spectrum, the mapping function, and the evaluation value to generate a spectrum having a broadened band. The wide-band spectrum generating unit 22 will be described in detail by referring to FIG. 8.

Figure 8:
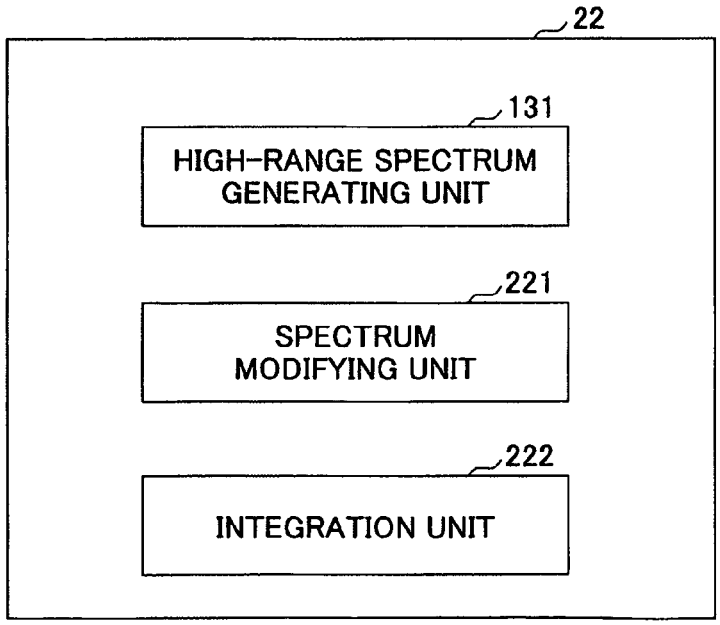
FIG. 8 is a block diagram illustrating an example of a main functional configuration of a wide-band spectrum generating unit.

FIG. 8 is a block diagram illustrating an example of a main functional configuration of the wide-band spectrum generating unit 22. As illustrated in FIG. 8, the wide-band spectrum generating unit 22 includes the high-range spectrum generating unit 131, a spectrum modifying unit 221, and an integration unit 222. With respect to the functions illustrated in FIG. 8, the same or similar functions as those of FIG. 2 are referred to by the same numerals, and a description thereof will be omitted.

The spectrum modifying unit 221 modifies the high-range spectrum generated by the high-range spectrum generating unit 131 by using the evaluation value calculated by the mapping function evaluating unit 21. For example, a formula (11) that multiplies the high-range spectrum by the evaluation value may be used for modification.

$$S'w[i] = \alpha \times Sw[i] \tag{11}$$

Sw[i]: High-Range Spectrum Generated by Applying Mapping Function

α: Evaluation Value of Mapping Function

S'w[i]: High-Range Spectrum Modified by Using Evaluation Value

The evaluation value α of the mapping function is obtained by the function (or correspondence table or the like) that derives an evaluation value from an error between the narrow-band signal spectrum and the spectrum generated by the mapping function as previously described (see FIG. 7).

The integration unit 222 is basically similar to the integration unit 132 described in connection with FIG. 2. It differs in that the high-range spectrum modified by the spectrum modifying unit 221 is used for integration. With this provision, the high-range spectrum generated by use of a mapping function having a small evaluation value has little effect on the integrated wide-band spectrum.

<Operation>

Figure 9:
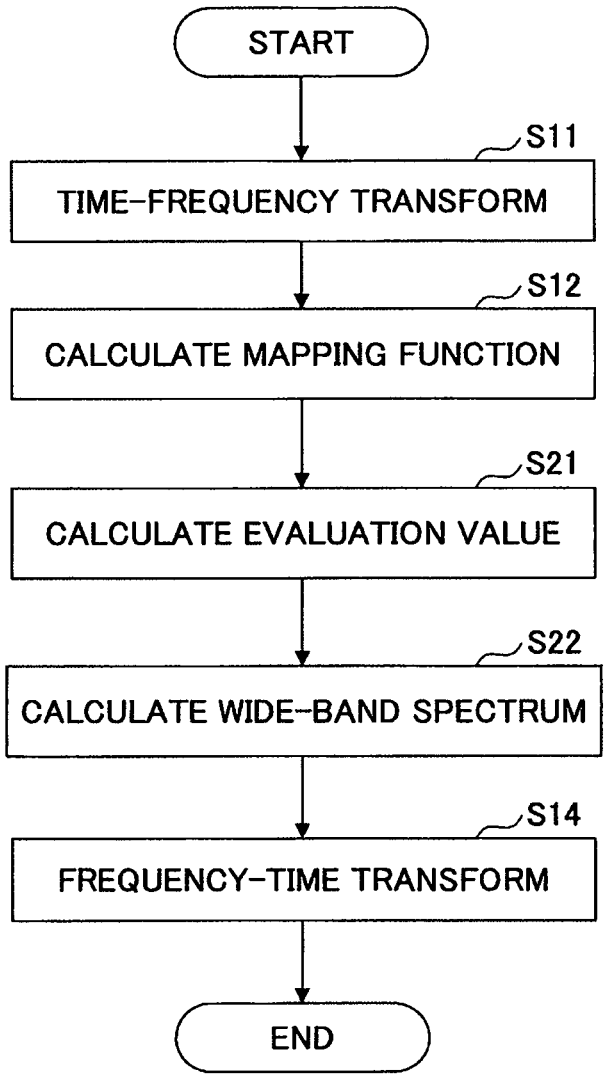
FIG. 9 is a flowchart illustrating an example of the voice band enhancing process according to the second embodiment.

In the following, a description will be given of the process performed by the voice band enhancement apparatus 2 according to the second embodiment. FIG. 9 is a flowchart illustrating an example of the voice band enhancing process according to the second embodiment. With respect to the steps illustrated in FIG. 9, the same or similar steps as those of FIG. 5 are referred to by the same numerals, and a description thereof will be omitted.

In step S21, the mapping function evaluating unit 21 evaluates the performance of the mapping function calculated by the mapping function calculating unit 12. Such an evaluation of the mapping function is made by deriving an evaluation value from an error that is obtained between the narrow-band spectrum and the spectrum generated by use of the mapping function as previously described.

In step S22, the wide-band spectrum generating unit 22 uses the evaluation value calculated by the mapping function evaluating unit 21 to modify the high-range spectrum that is generated by applying the mapping function. Such an modification is made by multiplying the spectrum by the evaluation value as previously described. The wide-band spectrum generating unit 22 then integrates the narrow-band spectrum and the modified high-range spectrum to generate a wide-band spectrum. In so doing, the smoothing process described in connection with the first embodiment may be additionally performed.

According to the second embodiment described above, an evaluation value of the calculated mapping function is calculated, and the high-range spectrum generated by using the mapping function may be modified based on the evaluation value. Namely, the high-range spectrum generated by use of a mapping function having poor performance has little effect on the integrated wide-band spectrum.

Third Embodiment

In the following, a voice band enhancement apparatus 3 according to a third embodiment will be described. The third embodiment differs from the previous embodiments in that the spectrum envelope is separated from a sound source signal with respect to the spectrum obtained by frequency transformation.

<Functional Configuration>

Figure 10:
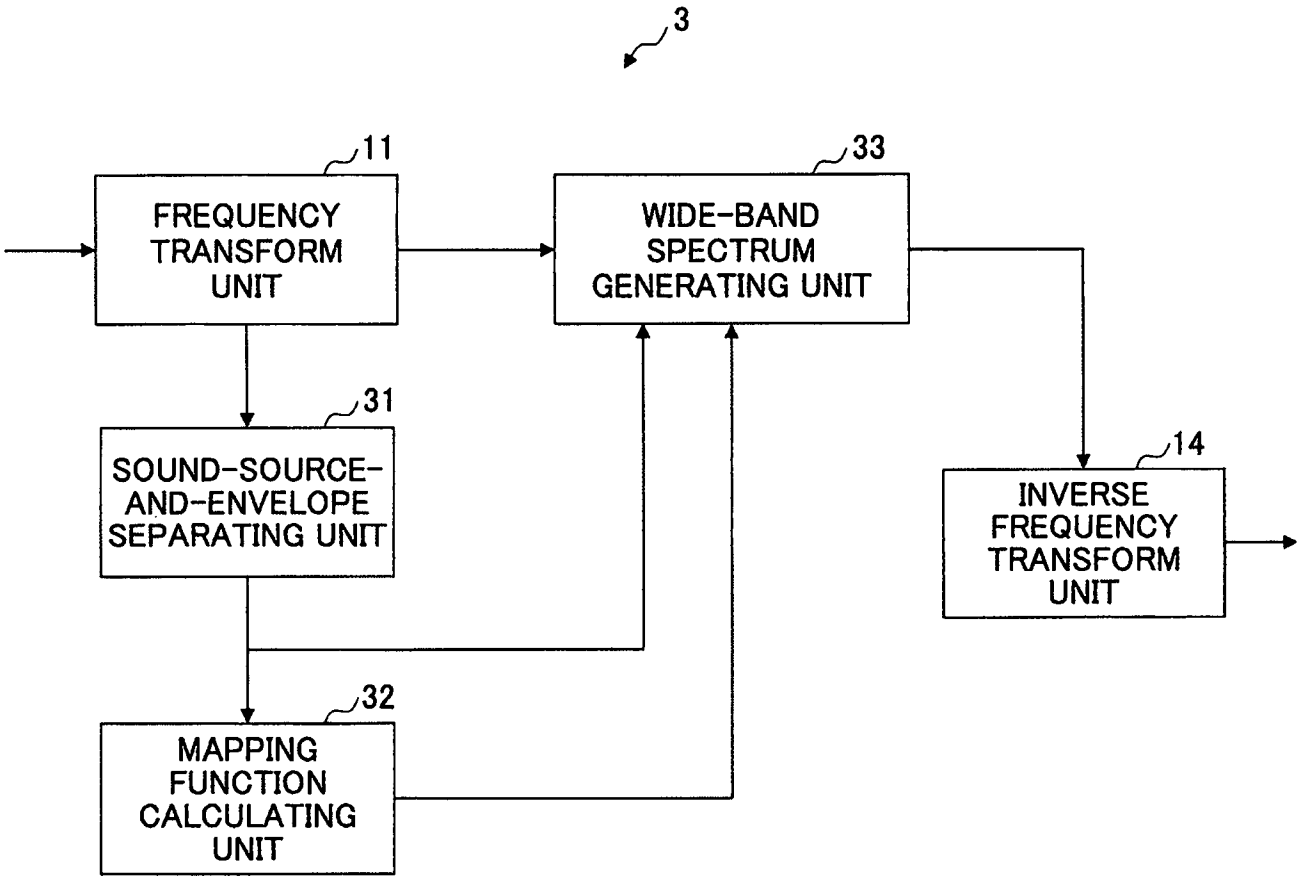
FIG. 10 is a block diagram illustrating an example of a main functional configuration of a voice band enhancer apparatus according to the third embodiment.

FIG. 10 is a block diagram illustrating an example of a main functional configuration of a voice band enhancement apparatus 3 according to the third embodiment. With respect to the functions illustrated in FIG. 10, the same or similar functions as those of FIG. 1 are referred to by the same numerals, and a description thereof will be omitted.

As illustrated in FIG. 10, the voice band enhancement apparatus 3 includes the frequency transform unit 11, a sound-source-and-envelope separating unit 31, a mapping function calculating unit 32, a wide-band spectrum generating unit 33, and the inverse frequency transform unit 14. In the following, the sound-source-and-envelope separating unit 31, the mapping function calculating unit 32, and the wide-band spectrum generating unit 33 will be described.

The sound-source-and-envelope separating unit 31 separates the spectrum calculated by the frequency transform unit 11 into the spectrum envelope and a sound source signal. This separation process is performed by use of a technology such as linear prediction analysis or a cepstrum lifter. The separated sound source signal and/or spectrum envelope are referred to as separate information. The sound-source-and-envelope separating unit 31 supplies the separate information to the mapping function calculating unit 32 and the wide-band spectrum generating unit 33.

The mapping function calculating unit 32 calculates a mapping function for generating higher range components from lower range components with respect to the separate information separated by the sound-source-and-envelope separating unit 31. The separate information for calculating a mapping function includes three patterns, i.e., the sound source signal and the spectrum envelope, the sound source signal alone, and the spectrum envelope alone. In the following, these will be described in sequence.

(Case of Sound Source Signal and Spectrum Envelope)

The mapping function calculating unit 32 calculates a mapping function with respect to each of the sound source signal and the spectrum envelope. A method of calculating a mapping function for the sound source signal is the same as that for a spectrum as described in connection with the previously described embodiments. A description of such a method will be omitted here. In the following, a description will be given of the method of calculating a mapping function with respect to a spectrum envelope.

First, a model (12) as follows is given as a mapping function for the spectrum envelope.

$$\hat{z}(x_i) = cx_i^2 + dx_i + e \tag{12}$$

$\hat{z}(x_i)$:

Power Spectrum Estimate of Spectrum Envelope at Frequency $x_i$ c, d, e: Mapping Function Parameter i: 0, . . . , N−1 (Frequency Band Index)

N: Number of Sections in Frequency Band

An error between the power spectrum estimate of the spectrum envelope and the actual power spectrum $z(x_i)$ of the spectrum envelope is calculated by use of formula (13).

$$E_2 = \sum_{i=0}^{N-1} \{cx_i^2 + dx_i + e - z(x_i)\} \tag{13}$$

$$\frac{\partial E_2}{\partial c} = 0 \tag{14}$$

$$\frac{\partial E_2}{\partial d} = 0 \tag{15}$$

$$\frac{\partial E_2}{\partial e} = 0 \tag{16}$$

Parameters c, d, and e of the model are calculated by formulas (13), (14), (15), and (16) using the power spectrum $z(x_i)$ of the narrow-band signal spectrum envelope. The calculation of the model parameters c, d, and e allows the calculation of a mapping function that achieves mapping from low-range components to high-range components with respect to the spectrum envelope. The model described above is only an example, and is not limited to this specific model. The mapping function calculating unit 32 supplies the calculated mapping functions for the sound source signal and spectrum envelope to the wide-band spectrum generating unit 33.

(Case of Sound Source Signal Alone)

The mapping function calculating unit 32 calculates a mapping function for mapping from low-range components to high-range components with respect to the sound source signal. A method of calculating a mapping function for the sound source signal is the same as that for a spectrum as described in connection with the previously described embodiments. A description of such a method will be omitted here. The mapping function calculating unit 32 supplies the calculated mapping function for the sound source signal to the wide-band spectrum generating unit 33.

(Case of Spectrum Envelope Alone)

The mapping function calculating unit 32 calculates a mapping function for mapping from low-range components to high-range components with respect to the spectrum envelope. A mapping function for the spectrum envelope may be calculated by providing a model and calculating the model parameters as previously described. The mapping function calculating unit 32 supplies the calculated mapping function for the spectrum envelope to the wide-band spectrum generating unit 33.

The wide-band spectrum generating unit 33 uses the separate information separated by the sound-source-and-envelope separating unit 31 and the mapping function calculated by the mapping function calculating unit 32 to generate separate information having a wider band than the narrow band. The wide-band spectrum generating unit 33 then generates a wide-band spectrum based on the generated wide-band separate information. The wide-band spectrum generating unit 33 will be described in detail by referring to FIG. 11.

Figure 11:
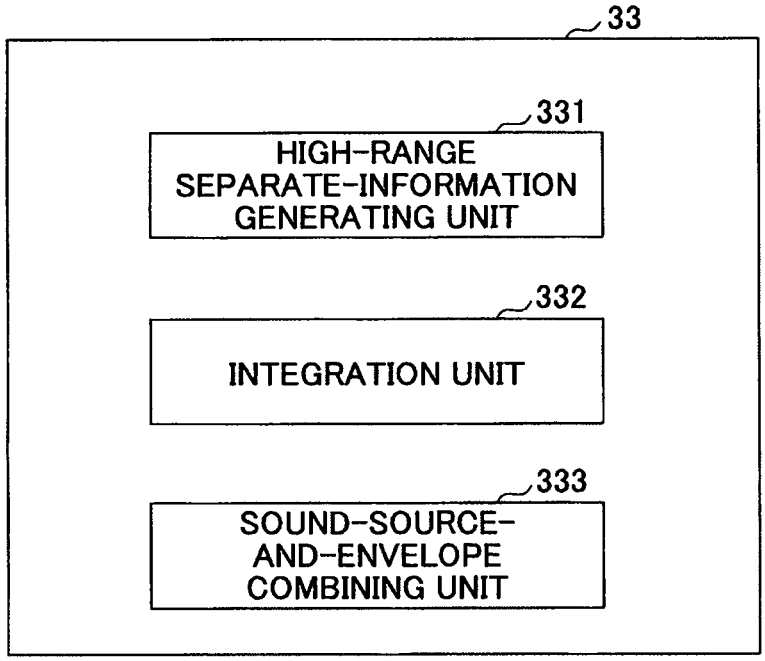
FIG. 11 is a block diagram illustrating an example of a main functional configuration of a wide-band spectrum generating unit.

FIG. 11 is a block diagram illustrating an example of a main functional configuration of the wide-band spectrum generating unit 33. As illustrated in FIG. 11, the wide-band spectrum generating unit 33 includes a high-range separate-information generating unit 331, an integration unit 332, and a sound-source-and-envelope combining unit 333.

The high-range separate-information generating unit 331 uses the calculated mapping function and frequencies higher than the narrow band to generate separate information in a range higher than the narrow band. As previously described, the separate information includes three patterns, i.e., the sound source signal and the spectrum envelope, the sound source signal alone, and the spectrum envelope alone. The function of the high-range separate-information generating unit 331 will be described with respect to each of these patterns.

(Case of Sound Source Signal and Spectrum Envelope)

The high-range separate-information generating unit 331 inputs high-range frequencies above the narrow band into the mapping functions calculated by the mapping function calculating unit 32 for the sound source signal and the spectrum envelope, thereby generating a high-range sound source signal and spectrum envelope. The high-range separate-information generating unit 331 then supplies the generated high-range sound source signal and spectrum envelope to the integration unit 332

(Case of Sound Source Signal Alone)

The high-range separate-information generating unit 331 inputs high-range frequencies above the narrow band into the mapping function calculated by the mapping function calculating unit 32 for the sound source signal, thereby generating a high-range sound source signal. Further, because the mapping function for the spectrum envelope is not calculated, the high-range separate-information generating unit 331 generates a high-range spectrum envelope by repeating a low-range spectrum or by using a pre-learned mapping function similarly to the manner it is used in the related art. The high-range separate-information generating unit 331 then supplies the generated high-range sound source signal and spectrum envelope to the integration unit 332.

(Case of Spectrum Envelope Alone)

The high-range separate-information generating unit 331 inputs high-range frequencies above the narrow band into the mapping function calculated by the mapping function calculating unit 32 for the spectrum envelope, thereby generating a high-range spectrum envelope. Further, because the mapping function for the sound source signal is not calculated, the high-range separate-information generating unit 331 generates a high-range sound source signal by repeating a low range or by using a pre-learned mapping function similarly to the manner it is used in the related art. The high-range separate-information generating unit 331 then supplies the generated high-range sound source signal and spectrum envelope to the integration unit 332.

The integration unit 332 integrates the narrow-band sound source signal and the high-range sound source signal generated by the high-range separate-information generating unit 331. The integration unit 332 also integrates the narrow-band spectrum envelope and the high-range spectrum envelope generated by the high-range separate-information generating unit 331. The method of integration is the same as that of the integration unit 132 of the first embodiment previously described. The integrated sound source signal and spectrum envelop are supplied to the sound-source-and-envelope combining unit 333.

The sound-source-and-envelope combining unit 333 combines the integrated wide-band sound source signal and spectrum envelope to generate a wide-band spectrum. Specifically, a wide-band signal spectrum is calculated by using the wide-band sound source signal spectrum and the wide-band spectrum envelope spectrum according to formula (17).

$$Sw[i]=SRw[i]\times EVw[i] \quad (17)$$

Sw[i]: i-th Wide-Band Signal Spectrum

SRw[i]: i-th Wide-Band Sound Source Signal Spectrum

EVw[i]: i-th Wide-Band Spectrum Envelope Spectrum

A description here has been given of an example in which processing is performed first by the integration unit 332 and then by the sound-source-and-envelope combining unit 333. Alternatively, the sound-source-and-envelope combining unit 333 may first perform combining, and, then, the integration unit 332 may perform integration. In this case, the sound-source-and-envelope combining unit 333 first combines the narrow-band sound source signal and spectrum envelope. The sound-source-and-envelope separating unit 33 combines the high-range sound source signal and spectrum envelope generated by the high-range separate-information generating unit 331. The integration unit 332 then integrates the combined narrow-band spectrum and high-range spectrum. At the time of integration by the integration unit 333, the smoothing process previously described may be performed.

Figure 12A:
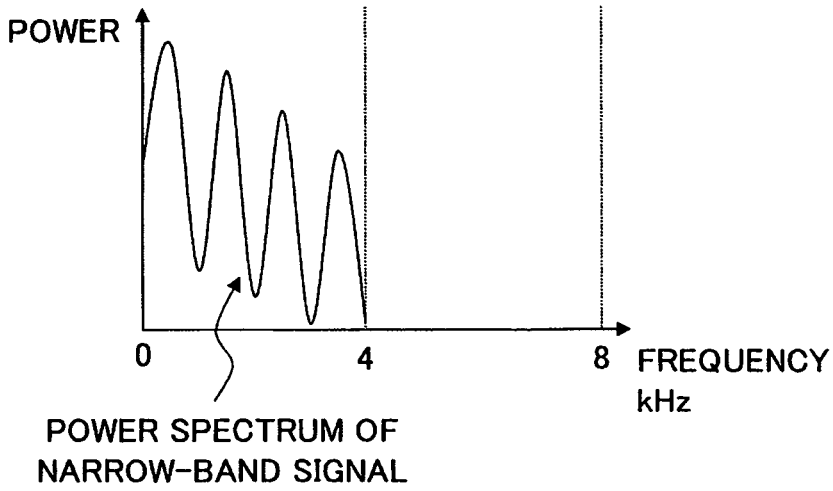
FIG. 12A is a drawing illustrating a narrow-band signal power spectrum.
Figure 12B:
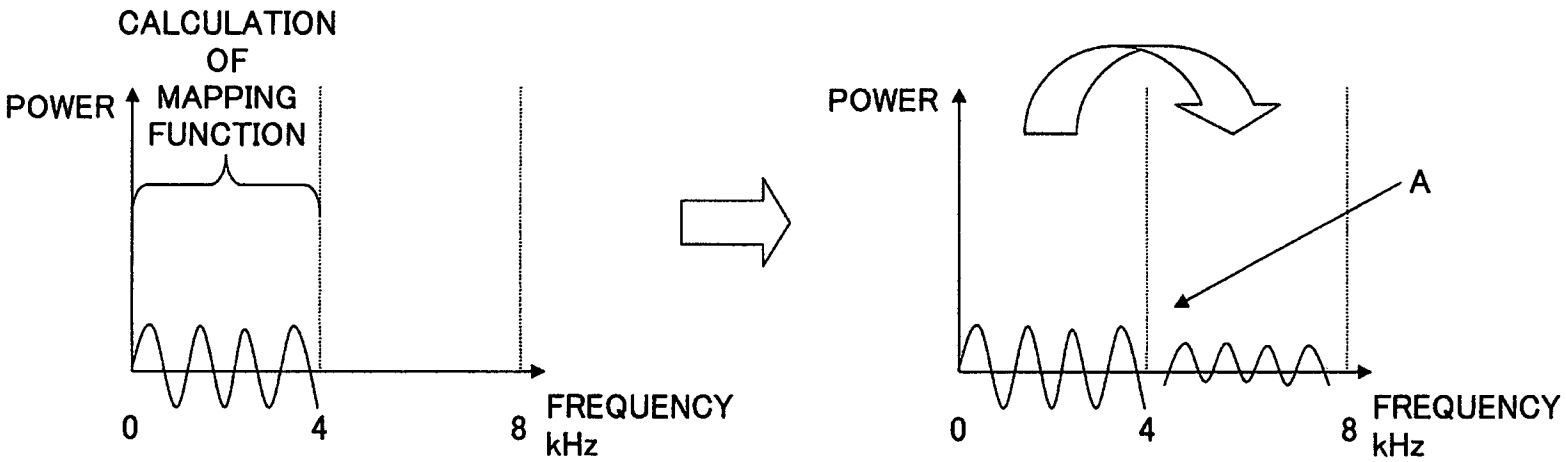
FIG. 12B is a drawing illustrating an example of providing a wider-band sound source signal.
Figure 12C:
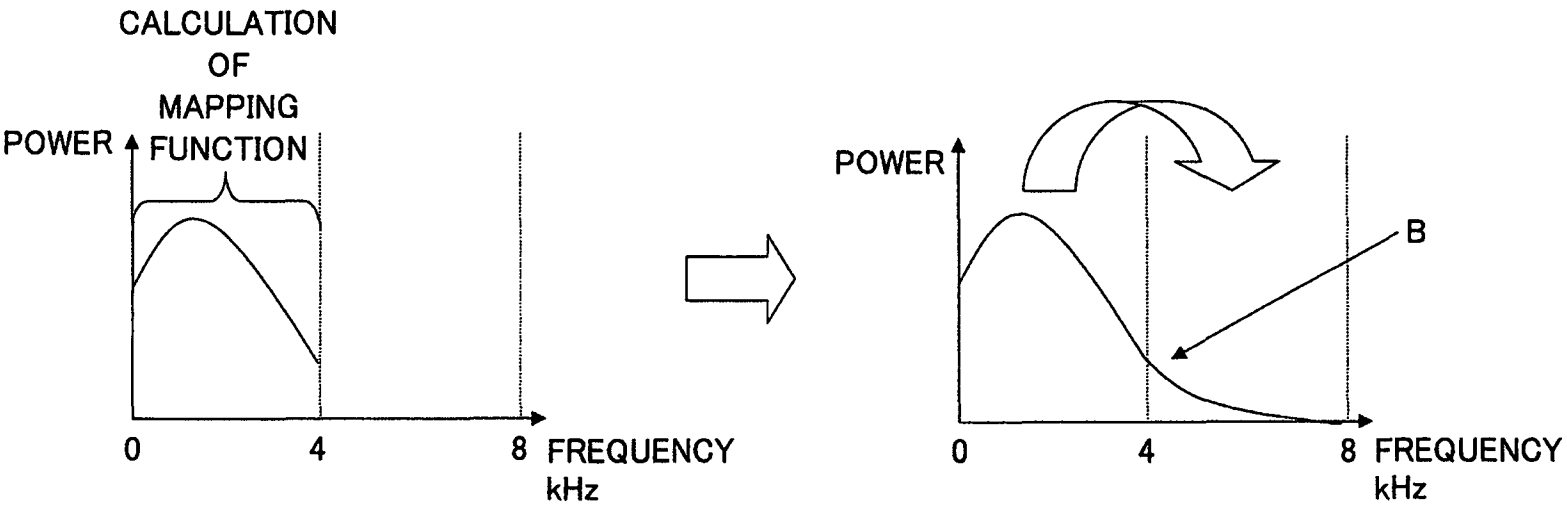
FIG. 12C is a drawing illustrating an example of providing a wider-band spectrum envelope.

With reference to FIGS. 12A through 12C and FIG. 13, an integration and combining process will be specifically described with respect to a case in which the separate information is a sound source signal and spectrum envelope FIG. 12A is a drawing illustrating a narrow-band signal power spectrum. FIG. 12B and FIG. 12C illustrate separating the narrow-band signal power spectrum into a sound source signal and a spectrum envelope, respectively.

FIG. 12B is a drawing illustrating an example of providing a wider-band sound source signal. As illustrated in FIG. 12B, a mapping function for generating high-range components from low-range components by using a sound source signal in the range of 0 to 4 kHz is calculated, and the calculated mapping function is used to generate a sound source signal in the range of 4 to 8 kHz. The generated sound source signal is integrated with the narrow-band sound source signal to generate a wider-band sound source signal A.

FIG. 12C is a drawing illustrating an example of providing a wider-band spectrum envelope. As illustrated in FIG. 12C, a mapping function for generating high-range components from low-range components by using a spectrum envelope in the range of 0 to 4 kHz is calculated, and the calculated mapping function is used to generate a spectrum envelope in the range of 4 to 8 kHz. The generated spectrum envelope is integrated with the narrow-band spectrum envelope to generate a wider-band spectrum envelope B.

Figure 13:
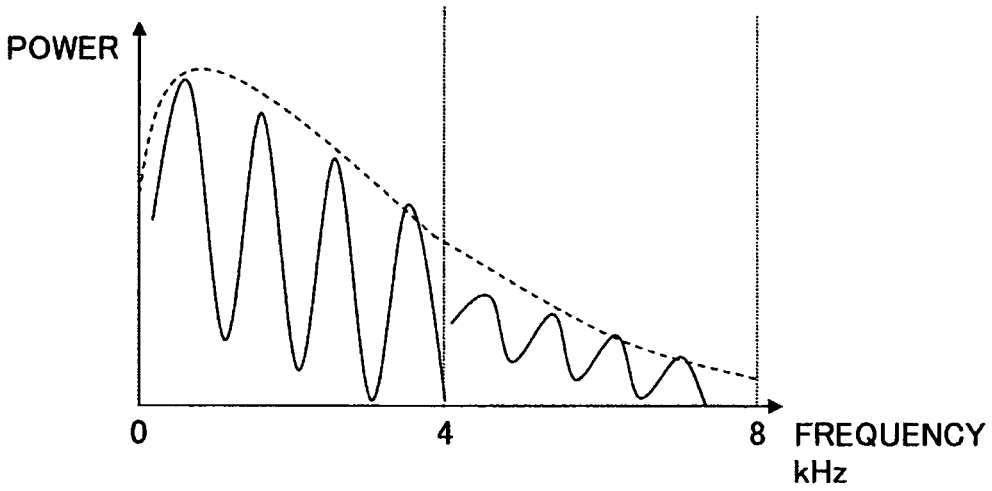
FIG. 13 is a drawing illustrating an example of the process of combining a sound source signal and a spectrum envelope.

FIG. 13 is a drawing illustrating an example of the process of combining a sound source signal and a spectrum' envelope. As illustrated in FIG. 13, the sound source signal A and the spectrum envelope B illustrated in FIG. 12B and FIG. 12C, respectively, are combined together to generate a wider-band spectrum. In this manner, even with the provision of the sound-source-and-envelope separating unit 31, mapping functions can be calculated based on the input signal spectrum, thereby generating a high-range spectrum suitable for the current input signal.

<Operation>

Figure 14:
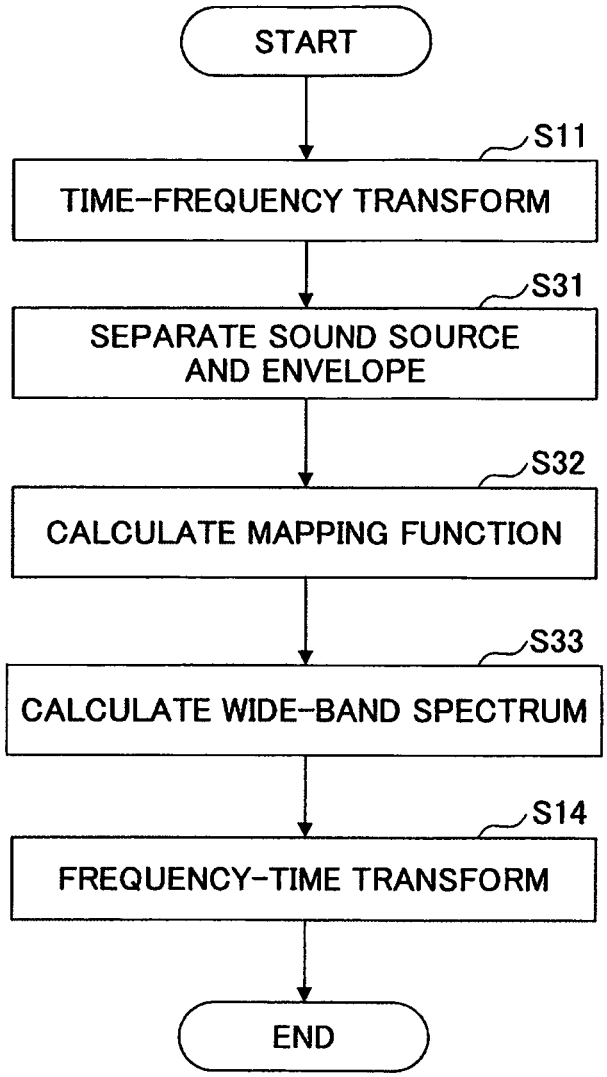
FIG. 14 is a flowchart illustrating an example of the voice band enhancing process according to the third embodiment.

In the following, a description will be given of the process performed by the voice band enhancement apparatus 3 according to the third embodiment. FIG. 14 is a flowchart illustrating an example of the voice band enhancing process according to the third embodiment. With respect to the steps illustrated in FIG. 14, the same or similar steps as those of FIG. 5 are referred to by the same numerals, and a description thereof will be omitted.

In step S31, the sound-source-and-envelope separating unit 31 separates the spectrum obtained by frequency transform into the spectrum envelope and a sound source signal.

In step S32, the mapping function calculating unit 32 calculates a mapping function for generating higher range components from lower range components by using the separate information separated by the sound-source-and-envelope separating unit 31. Specifically, a model of the mapping function is provided, and its parameters are calculated as previously described. The patterns for calculating mapping functions includes three patterns, i.e., mapping functions for the sound source signal and the spectrum envelope, a mapping function for the sound source signal alone, and a mapping function for the spectrum envelope alone.

In step S33, the wide-band spectrum generating unit 33 uses the mapping function calculated by the mapping function calculating unit 32 to generate the separate information in a range higher than the narrow band. If mapping functions are calculated for the sound source signal and the spectrum envelope at this time, these mapping functions are used to generate a high-range sound source signal and spectrum envelope. If a mapping function is calculated only for the sound source signal, this mapping function for the sound source signal is used to generate a high-range sound source signal. A high-range spectrum envelop is generated by using a related-art technique. If a mapping function is calculated only for the spectrum envelope, this mapping function for the spectrum envelope is used to generate a high-range spectrum envelope. A high-range sound source signal is generated by using a related-art technique.

The wide-band spectrum generating unit 33 integrates the generated high-range sound source signal and spectrum envelope with the narrow-band sound source signal and spectrum envelope, respectively. The integrated sound source signal and spectrum envelope are then combined to generate a wide-band spectrum. In so doing, the smoothing process described in connection with the first embodiment may be additionally performed.

According to the third embodiment described above, the narrow-band signal spectrum is separated into a sound source signal and the spectrum envelope, and such separate information is used to calculate a mapping function for generating high-range components from low-range components. Further, the calculated mapping function is used to generate a high-range spectrum for band broadening, thereby making it possible to provide a wide-band signal having high sound quality. Further, a mapping function suitable for the input signal is obtained, which makes it possible to generate a high-range spectrum responsive to the characteristics of the input signal spectrum.

Fourth Embodiment

In the following, a voice band enhancement apparatus 4 according to a fourth embodiment will be described. In the fourth embodiment, a mapping function calculated based on separate information is evaluated. Based on this evaluation, a decision may be made as to how much contribution is made by a calculated high-range spectrum and whether such a spectrum is at all used.

<Functional Configuration>

Figure 15:
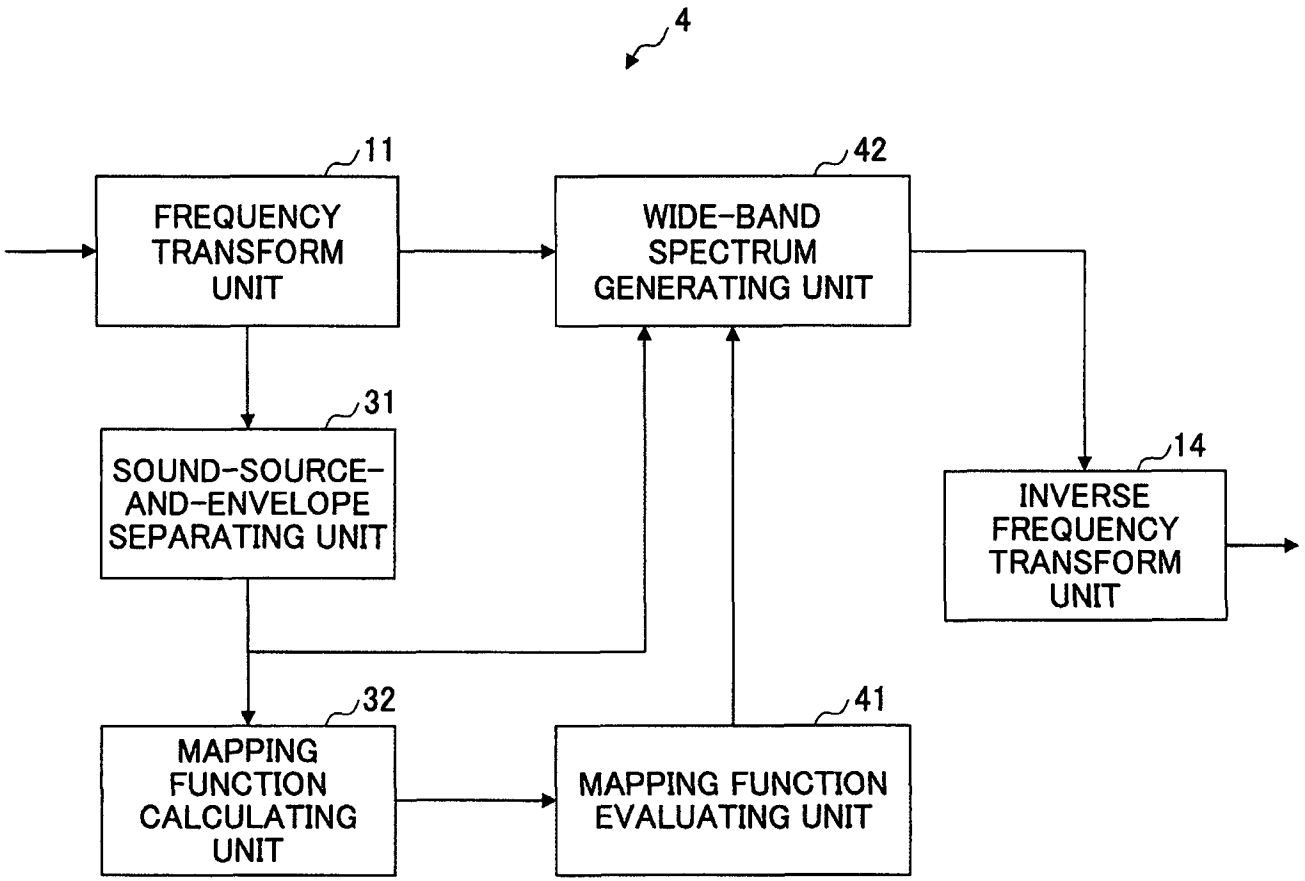
FIG. 15 is a block diagram illustrating an example of a main functional configuration of a voice band enhancer apparatus according to the fourth embodiment.

FIG. 15 is a block diagram illustrating an example of a main functional configuration of a voice band enhancement apparatus 4 according to the fourth embodiment. With respect to the functions illustrated in FIG. 15, the same or similar functions as those of FIG. 1 and FIG. 10 are referred to by the same numerals, and a description thereof will be omitted.

As illustrated in FIG. 15, the voice band enhancement apparatus 4 includes the frequency transform unit 11, the sound-source-and-envelope separating unit 31, the mapping function calculating unit 32, a mapping function evaluating unit 41, a wide-band spectrum generating unit 42, and the inverse frequency transform unit 14. In the following, the mapping function evaluating unit 41 and the wide-band spectrum generating unit 42 will be described.

The mapping function evaluating unit 41 evaluates the performance of the mapping function calculated by the mapping function calculating unit 32. Such an evaluation is made similarly to the evaluation made by the mapping function evaluating unit 21 of the second embodiment. Namely, in the case in which a mapping function is calculated only for the sound source signal, an error is calculated from the narrow-band sound source signal and the sound source signal generated by use of the mapping function for the sound source signal, followed by obtaining an evaluation value from the error to evaluate the mapping function.

Such an evaluation is made similarly also in the case in which a mapping function is calculated only for the spectrum envelope and in the case in which respective mapping functions are calculated for the sound source signal and the spectrum envelope.

The wide-band spectrum generating unit 42 uses the evaluation value and mapping function obtained from the mapping function evaluating unit 41 and the narrow-band sound source signal and spectrum envelope obtained from the sound-source-and-envelope separating unit 31 to generate a wide-band spectrum. The wide-band spectrum generating unit 42 will be described in detail by referring to FIG. 16.

Figure 16:
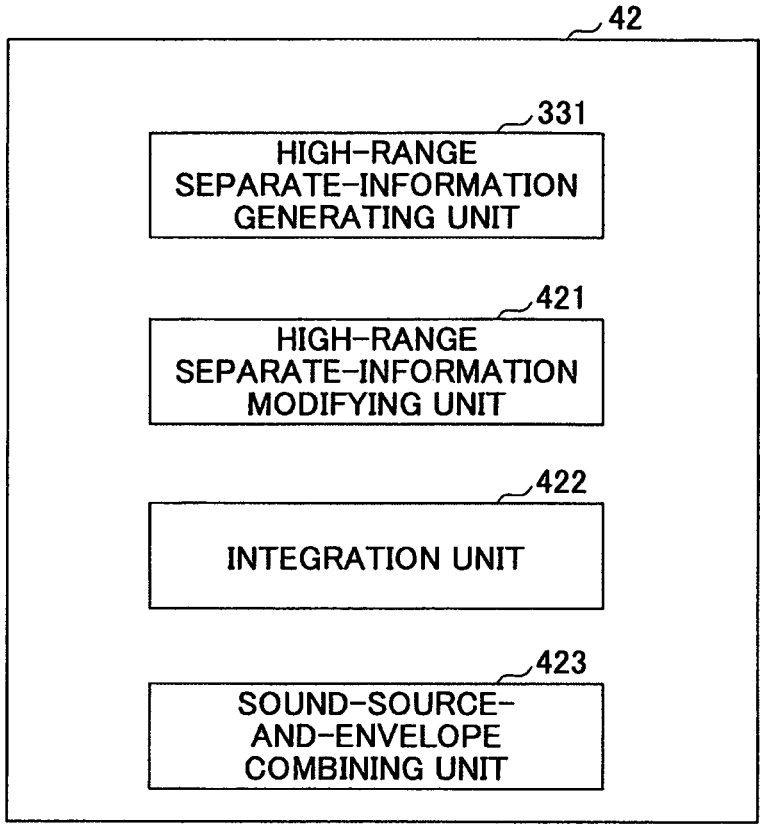
FIG. 16 is a block diagram illustrating an example of a main functional configuration of a wide-band spectrum generating unit.

FIG. 16 is a block diagram illustrating an example of a main functional configuration of the wide-band spectrum generating unit 42. With respect to the functions illustrated in FIG. 16, the same or similar functions as those of FIG. 11 are referred to by the same numerals, and a description thereof will be omitted. As illustrated in FIG. 16, the wide-band spectrum generating unit 42 includes the high-range separate-information generating unit 331, an high-range separate-information modifying unit 421, an integration unit 422, and a sound-source-and-envelope combining unit 423.

The high-range separate-information modifying unit 421 uses the evaluation value of the mapping function to modify the separate information that is generated by the high-range separate-information generating unit 331 in the range higher than the narrow band. As previously described, the separate information includes three patterns, i.e., the sound source signal and the spectrum envelope, the sound source signal alone, and the spectrum envelope alone. The function of the high-range separate-information modifying unit 421 will be described with respect to each of these patterns.

(Case of Sound Source Signal and Spectrum Envelope)

The high-range separate-information modifying unit 421 uses the evaluation values of the mapping functions to modify the high-range sound source signal and spectrum envelope generated by the high-range separate-information generating unit 331. First, modification to the sound source signal will be described.

The evaluation value of the mapping function for the sound source signal is employed to modify the high-range sound source signal generated by use of the mapping function for the sound source signal according to formula (18).

$$SR'w[i]=\beta\times SRw[i] \tag{18}$$

SRw[i]: High-Range Sound Source Signal Generated by Applying Mapping Function for Sound Source Signal SR' w[i]: High-Range Sound Source Signal Modified by Using Evaluation Value β: Evaluation Value of Mapping Function for Sound Source Signal The evaluation value β of the mapping function is obtained by the function (or correspondence table) that derives an evaluation value from an error between the narrow-band signal sound source signal and the sound source signal calculated by the mapping function.

Next, modification to the spectrum envelope will be described. The evaluation value of the mapping function for the spectrum envelope is employed to modify the high-range spectrum envelope generated by use of the mapping function for the spectrum envelope according to formula (19).

$$SE'w[i]=\gamma\times SEw[i] \quad (19)$$

SEw[i]: High-Range Spectrum Envelope Generated by Applying Mapping Function for Spectrum Envelope SE'w[i]: High-Range Spectrum Envelope Modified by Using Evaluation Value γ: Evaluation Value of Mapping Function for Spectrum Envelope The evaluation value γ of the mapping function is obtained by the function (or correspondence table) that derives an evaluation value from an error between the narrow-band signal spectrum envelope and the spectrum envelope generated by the mapping function as previously described.

In this manner, the respective evaluation values for the sound source signal and spectrum envelope are used to generate a modified high-range sound source signal and spectrum envelope. The high-range separate-information generating unit 331 then supplies the modified high-range sound source signal and spectrum envelope to the integration unit 422.

(Case of Sound Source Signal Alone)

The high-range separate-information modifying unit 421 uses the evaluation value of the mapping function for the sound source signal to modify the sound source signal generated by the high-range separate-information generating unit 331. The method of modification is the same as the one previously described. Since a mapping function is not calculated for the spectrum envelope, the high-range spectrum envelope is not modified here. The high-range separate-information generating unit 331 then supplies the modified high-range sound source signal and the unmodified high-range spectrum envelope to the integration unit 332.

(Case of Spectrum Envelope Alone)

The high-range separate-information modifying unit 421 uses the evaluation value of the mapping function for the spectrum envelope to modify the spectrum envelope generated by the high-range separate-information generating unit 331. The method of modification is the same as the one previously described. Since a mapping function is not calculated for the sound source signal, the high-range sound source signal is not modified here. The high-range separate-information generating unit 331 then supplies the modified high-range spectrum envelope and the unmodified high-range sound source signal to the integration unit 332.

The integration unit 422 integrates the narrow-band sound source signal and the high-range sound source signal output from the high-range separate-information modifying unit 421. The integration unit 332 also integrates the narrow-band spectrum envelope and the high-range spectrum envelope output from the high-range separate-information modifying unit 421. The method of integration is the same as that of the integration unit 132 of the first embodiment previously described. The integrated sound source signal and spectrum envelop are supplied to the sound-source-and-envelope combining unit 423.

The sound-source-and-envelope combining unit 423 combines the integrated wide-band sound source signal and spectrum envelope to generate a wide-band spectrum.

A description here has been given of an example in which processing is performed first by the integration unit 422 and then by the sound-source-and-envelope combining unit 423. Alternatively, the sound-source-and-envelope combining unit 423 may first perform combining, and, then, the integration unit 422 may perform integration. In this case, the sound-source-and-envelope combining unit 423 first combines the narrow-band sound source signal and spectrum envelope. The sound-source-and-envelope combining unit 423 also combines the high-range sound source signal and spectrum envelope output from the high-range separate-information modifying unit 421. The integration unit 422 then integrates the combined narrow-band spectrum and high-range spectrum.

At the time of integration by the integration unit 423, the smoothing process previously described may be performed. In this manner, mapping functions calculated based on separate information are evaluated. Based on this evaluation, a decision may be made as to how much contribution is made by a calculated high-range spectrum and whether such a spectrum is at all used.

<Operation>

Figure 17:
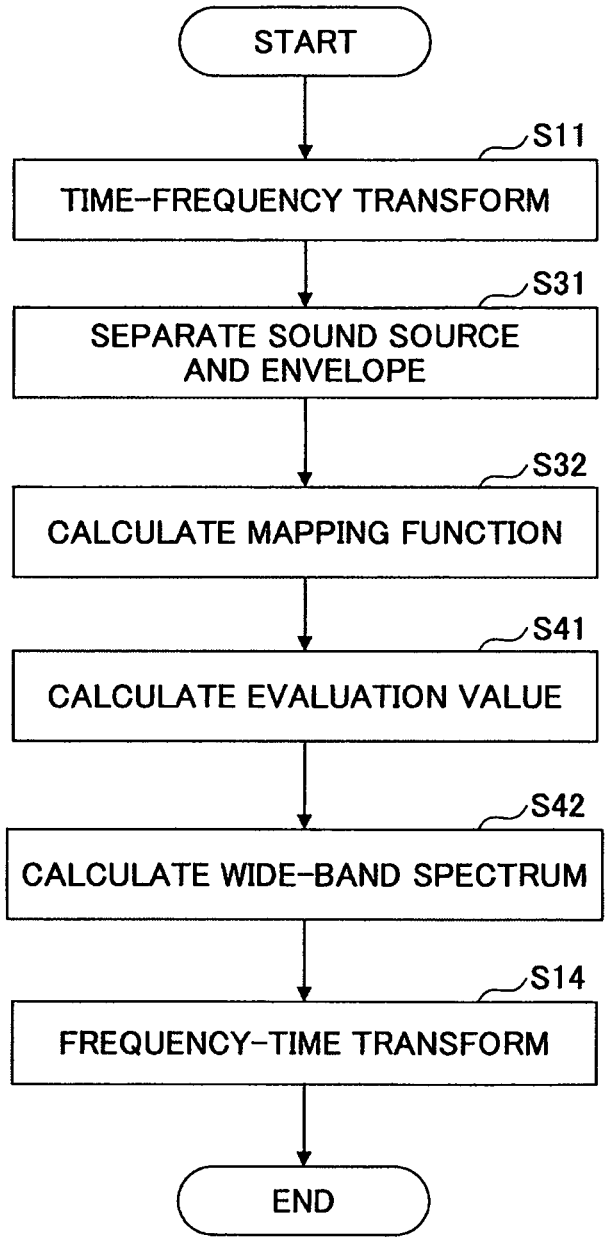
FIG. 17 is a flowchart illustrating an example of the voice band enhancing process according to the fourth embodiment.

In the following, a description will be given of the process performed by the voice band enhancement apparatus 4 according to the fourth embodiment. FIG. 17 is a flowchart illustrating an example of the voice band enhancing process according to the fourth embodiment. With respect to the steps illustrated in FIG. 17, the same or similar steps as those of FIG. 5 and FIG. 14 are referred to by the same numerals, and a description thereof will be omitted.

In step S41, the mapping function evaluating unit 41 evaluates the performance of the mapping function calculated by the mapping function calculating unit 32. Such an evaluation is made by calculating an evaluation value of a mapping function as previously described.

In step S42, the wide-band spectrum generating unit 42 uses the mapping function calculated by the mapping function calculating unit 32 to generate the separate information in a range higher than the narrow band. If mapping functions are calculated for the sound source signal and the spectrum envelope at this time, these mapping functions are used to generate a high-range sound source signal and spectrum envelope. If a mapping function is calculated only for the sound source signal, this mapping function for the sound source signal is used to generate a high-range sound source signal. A high-range spectrum envelop is generated by using a related-art technique. If a mapping function is calculated only for the spectrum envelope, this mapping function for the spectrum envelope is used to generate a high-range spectrum envelope. A high-range sound source signal is generated by using a related-art technique.

The wide-band spectrum generating unit 42 uses the evaluation value(s) of the mapping function(s) to modify the sound source signal and/or spectrum envelope generated by using the mapping function(s) calculated by the mapping function calculating unit 32. In the case in which either the sound source signal or the spectrum envelope is generated by applying a related-art technique, this sound source signal or spectrum envelope is not modified.

The wide-band spectrum generating unit 42 then integrates the high-range sound source signal and spectrum envelope with the narrow-band sound source signal and spectrum envelope, respectively. The wide-band spectrum generating unit 42 also combines the integrated sound source signal and spectrum envelope to generate a wider-band spectrum. In so doing, the smoothing process described in connection with the first embodiment may be additionally performed.

According to the fourth embodiment described above, the spectrum is separated into the sound source signal and the spectrum envelope, and the mapping functions calculated based on the separate information are evaluated. Based on this evaluation, a decision may be made as to how much contribution is made by a calculated high-range spectrum and whether such a spectrum is at all used.

[Variation]

In the following, a variation of the embodiments described heretofore will be described. In these embodiments, a mapping function is calculated by providing a model of a mapping function and calculating its parameters. Here, linear prediction coefficients are calculated. In the following, how to obtain linear prediction coefficients will be described.

In a matrix A in equation (20), narrow-band spectrums are arranged. A column vector b includes a spectrum having a frequency index that is larger by q than the first row of the matrix A. Linear prediction coefficients p are calculated according to equation (23) by calculating an inverse matrix of the matrix A. The inverse matrix of A is obtained by use of a known method such as a generalized inverse matrix.

The linear prediction coefficients p serve to predict, using a low-range spectrum of the narrow-band signal as an input, a high-range spectrum higher by q than the low-range spectrum.

$$Ap=b \tag{20}$$

A: Matrix of m×o (i.e., matrix in which narrow-band signal spectrums are arranged)

p: Linear Prediction Coefficients (m-dimensional column vector)

b: Column Vector (o-dimensional column vector) in which a spectrum having a frequency index larger by q than the first row of the matrix A is arranged $$A=\begin{pmatrix} s_t & s_{t-1} & s_{t-2} & \cdots & s_{t-m+1} \\ s_{t-1} & s_{t-2} & s_{t-3} & \cdots & s_{t-m} \\ s_{t-2} & s_{t-3} & s_{t-4} & \cdots & s_{t-m-1} \\ \cdots & \cdots & \cdots & \cdots & \cdots \\ s_{t-o+1} & s_{t+o} & s_{t-o-1} & \cdots & s_{t-o-m+2} \end{pmatrix} \tag{21}$$

$$b=[s_{t+q} \quad s_{t+q-1} \quad \cdots \quad s_{t+q-m+1}]^T \tag{22}$$

st: Spectrum Having Frequency Index t $$p=A^{-1}b \tag{23}$$

In the following, a description will be given of an example of calculating a high-range spectrum by use of the calculated linear prediction coefficients. A spectrum in a range higher than the input signal (i.e., the narrow-band signal) spectrum is generated by multiplying the matrix A' in equation (24) by the linear prediction coefficients.

$$A'p=b' \tag{24}$$

A': Matrix of m×o (i.e., matrix in which narrow-band signal spectrums are arranged)

p: Linear Prediction Coefficients (m-dimensional column vector)

b': High-Range Spectrum (o-dimensional column vector)

By use of equation (24), a spectrum having a frequency index that is larger by q than the first row of the matrix A' is calculated. The high-range spectrum generated by use of the linear prediction coefficients is as follows.

The calculated results (b') are set to the range (t to t−o+2q) calculable by the linear prediction coefficients, and zero is set to the incalculable range (t−o+2q to 2T−1).

$$S_f[t-o+1+q+i]=b'[i] \quad i=0,,,,q-1 \tag{25}$$

$$S_f[t-o+2q+i]=0 \quad i=0,,,,2T-1-t+o-2q \tag{26}$$

S_f[i]: i-th Spectrum Generated by Using Linear Prediction Coefficients t: Largest Frequency Index of Narrow-Band Spectrum To Which Linear Prediction Coefficients Are Applied Integration of the narrow-band signal spectrum and the high-range spectrum higher than the narrow band may be performed similarly to integration described in each embodiment. The above description has been given with respect to an example in which linear prediction coefficients are calculated for spectrum. Linear prediction coefficients may be similarly calculated for a sound source signal and a spectrum envelope.

The method of generating high-range spectrum by calculating linear prediction coefficients can generate a high-range spectrum by flexibly reflecting the characteristics of input signal spectrum. Such generation may be more flexible than the method that provides a model and calculates the model parameters. This is because there is no need to provide a model.

The procedure of voice band enhancement as described in the above-noted embodiments may be implemented as a program for causing a computer to practice the procedure. Such a program may be installed from a server or the like to a computer for execution by the computer, thereby performing the voice band enhancement procedure.

This program may be recorded in a recording medium (e.g., CD-ROM, SD card, or the like). Such a recording medium having the program recorded therein may be read by a computer or a portable terminal, thereby performing the voice band enhancement procedure as previously described. The recording medium may be any type of recording medium. That is, it may be a recording medium for recording information by use of an optical, electrical, or magnetic means such as a CD-ROM, a flexible disk, or a magneto-optical disk, or may be a semiconductor memory for recording information by use of an electrical means such as a ROM or a flash memory. The voice band enhancement apparatus disclosed herein may be applied to devices such as mobile terminals and IP telephones.

Further, the present invention is not limited to these embodiments, but various variations and modifications may be made without departing from the scope of the present invention.

The invention claimed is:

1. A voice band enhancement tangible hardware apparatus, comprising a computer, the computer performing:

a frequency transform procedure to perform frequency transform on an input signal to calculate a spectrum;

a mapping function calculating procedure to calculate, by use of the spectrum, a mapping function for generating high-range components from low-range components of the spectrum;

a wide-band spectrum generating procedure to generate, in a higher range than a band of the spectrum, a high-range spectrum based on the mapping function and to integrate the generated high-range spectrum and the spectrum calculated by the frequency transform unit, thereby generating a wide-band spectrum wider than the band of the spectrum calculated by the frequency transform procedure;

an inverse frequency transform procedure to perform inverse frequency transform on the wide-band spectrum to calculate an output signal;

a separation procedure to separate the spectrum calculated by the frequency transform procedure into a sound source signal and a spectrum envelope; and an evaluation value calculating procedure, wherein the mapping function calculating procedure uses separate information separated by the separation procedure, and calculates a mapping function for generating high-range components from low-range components of the separate information, and wherein the wide-band spectrum generating procedure generates, in a higher range than the band of the spectrum, high-range separate information based on the mapping function and to integrate the generated high-range separate information and the separate information separated by the separation procedure, thereby generating the wide-band spectrum based on the integrated separate information, wherein the evaluation value calculating procedure calculates an evaluation value of the mapping function by use of an error between separate information generated based on the mapping function and the separate information separated by the separation procedure, the evaluation value decreasing as the error increases, and wherein the wide-band spectrum generating procedure modifies the high-range separate information by multiplying the high-range separate information by the evaluation value that decreases as the error increases.

2. The voice band enhancement tangible hardware apparatus as claimed in claim 1, wherein the separate information is the sound source signal and/or the spectrum envelope.

3. The voice band enhancement tangible hardware apparatus as claimed in claim 1, wherein the mapping function is a function to calculate linear prediction coefficients.

4. The voice band enhancement tangible hardware apparatus as claimed in claim 1, wherein the wide-band spectrum generating procedure includes:

a high-range spectrum generating procedure to generate, in a range higher than the band of the spectrum, a high-range spectrum by use of the mapping function and frequencies in a range higher than the band of the spectrum; and an integration procedure to integrate the high-range spectrum and the spectrum calculated by the frequency transform procedure.

5. The voice band enhancement tangible hardware apparatus as claimed in claim 4, wherein the integration procedure performs a smoothing process such that high-range components of the spectrum calculated by the frequency transform procedure gradually becomes equal to the spectrum generated by the mapping function.

6. A voice band enhancement method, comprising:

performing, via a processor, operations comprising:

a frequency transform procedure to perform frequency transform on an input signal to calculate a spectrum;

a mapping function calculating procedure to calculate, by use of the spectrum, a mapping function for generating high-range components from low-range components of the spectrum;

a wide-band spectrum generating procedure to generate, in a higher range than a band of the spectrum, a high-range spectrum based on the mapping function and to integrate the generated high-range spectrum and the spectrum calculated by the frequency transform procedure, thereby generating a wide-band spectrum wider than the band of the spectrum calculated by the frequency transform procedure;

an inverse frequency transform procedure to perform inverse frequency transform on the wide-band spectrum to calculate an output signal; and a separation procedure to separate the spectrum calculated by the frequency transform procedure into a sound source signal and a spectrum envelope; and an evaluation value calculating procedure, wherein the mapping function calculating procedure uses separate information separated by the separation procedure, and calculates a mapping function for generating high-range components from low-range components of the separate information, wherein the wide-band spectrum generating procedure generates, in a higher range than the band of the spectrum, high-range separate information based on the mapping function and to integrate the generated high-range separate information and the separate information separated by the separation procedure, thereby generating the wide-band spectrum based on the integrated separate information, wherein the evaluation value calculating procedure calculates an evaluation value of the mapping function by use of an error between separate information generated based on the mapping function and the separate information separated by the separation procedure, the evaluation value decreasing as the error increases, and wherein the wide-band spectrum generating procedure modifies the high-range separate information by multiplying the high-range separate information by the evaluation value that decreases as the error increases.

* * * * *

UNITED STATES PATENT AND TRADEMARK OFFICE

CERTIFICATE OF CORRECTION

PATENT NO. : 8,781,823 B2
APPLICATION NO. : 13/067120
DATED : July 15, 2014
INVENTOR(S) : Endo It is certified that error appears in the above-identified patent and that said Letters Patent is hereby corrected as shown below:

On the Title Page 2 Item [56] (OTHER PUBLICATIONS), Line 6, after "corresponding European Patent" insert -- Application --.

Signed and Sealed this
Eleventh Day of November, 2014

Michelle K. Lee

Michelle K. Lee
*Deputy Director of the United States Patent and Trademark Office*